US005303680A

United States Patent [19]

Nielsen

[11] Patent Number: 5,303,680

[45] Date of Patent: Apr. 19, 1994

[54] LASH ADJUSTING MECHANISM FOR MULTI VALVE ENGINE

[75] Inventor: Douglas L. Nielsen, Marshall, Mich.

[73] Assignee: Eaton Corporation, Cleveland, Ohio

[21] Appl. No.: 74,188

[22] Filed: Jun. 10, 1993

[51] Int. Cl.[5] ..... F01L 1/24; F01L 1/26

[52] U.S. Cl. ..... 123/90.22; 123/90.4; 123/90.45

[58] Field of Search ..... 123/90.22, 90.23, 90.39, 123/90.4, 90.41, 90.43, 90.45, 90.46

[56] References Cited

U.S. PATENT DOCUMENTS

| | | | |
|---|---|---|---|
| 4,517,935 | 5/1985 | Pomfret | 123/90.4 |
| 4,677,723 | 7/1987 | Greene, Sr. | 123/90.22 |
| 4,922,867 | 5/1990 | Mathews | 123/90.22 |
| 4,924,821 | 5/1990 | Teerman | 123/90.22 |
| 5,150,672 | 9/1992 | Fischer et al. | 123/90.22 |

*Primary Examiner*—Raymond A. Nelli
*Assistant Examiner*—Weilun Lo
*Attorney, Agent, or Firm*—F. M. Sajovec

[57] ABSTRACT

An engine valve actuating system wherein a pair of valves is actuated by a single cam lobe. The system includes a primary rocker arm contacting the cam lobe and a secondary rocker arm or actuating plate which is contacted by the primary rocker arm and which contacts both valves and a pair of lash adjusters. The points of contact of the actuating plate with the valves and the lash adjusters are arranged in four corners with the point of contact of the primary rocker arm with the actuating plate being within a triangle defined by a line connecting the points of contact of the valves with the actuating plate and the point where lines connecting those points with the diagonally opposite points of contact of the actuating plate with the lash adjusters intersect.

4 Claims, 2 Drawing Sheets

LASH ADJUSTING MECHANISM FOR MULTI VALVE ENGINE

The present invention relates generally to a valve train for an internal combustion engine, and more particularly to a system wherein the valve locations and orientation are fixed and not necessarily equidistant from the camshaft centerline and wherein it is desirable to operate dual intake or exhaust valves using a single cam lobe.

It is well-know to operate dual valves by means of a single cam lobe, as shown by U.S. Pat. No. 4,881,497; however, prior art systems are based on an assumption that for each pair of valves so operated, the lash is essentially equal. This, however, is not necessarily the case, since the lash can vary from valve-to-valve. The prior art systems are capable of accommodating thermal and wear related changes only if both value systems react alike. In actual practice, it is possible that one of the valve seats will wear more rapidly than the other, and it is possible that one of the valves will operate significantly hotter than the other. Under such conditions the single lash adjuster of the prior art system cannot be relied upon to properly adjust the lash in both valves in every valve event cycle.

The present invention provides for such valve-to-valve lash variation by means of a secondary rocker arm structure in the form of an actuating plate which defines a pair of valve-actuating lobes at a first pair of corners, and a pair of lash-adjuster-actuating lobes at opposite corners. The secondary arm is oriented with respect to the primary rocker arm and to the valves such that the effective point of contact between the primary rocker arm and the secondary rocker arm is preferably within or near a triangle defined by the center of the tips of the two valves and the point where lines drawn between each valve tip and the centerline of the diagonally opposite lash adjuster intersect. The secondary rocker arm thus rotates about a line defined by the points of contact between the lash adjusters and the secondary rocker arm. Since the lash adjusters dynamically adjust each point, the axis of rotation of the secondary rocker arm is thus dynamically adjusted cycle to cycle to accommodate the valve to valve variation.

Other objects and advantages of the invention will be apparent from the following description when taken in connection with the accompanying drawings, wherein.

Figure 1:
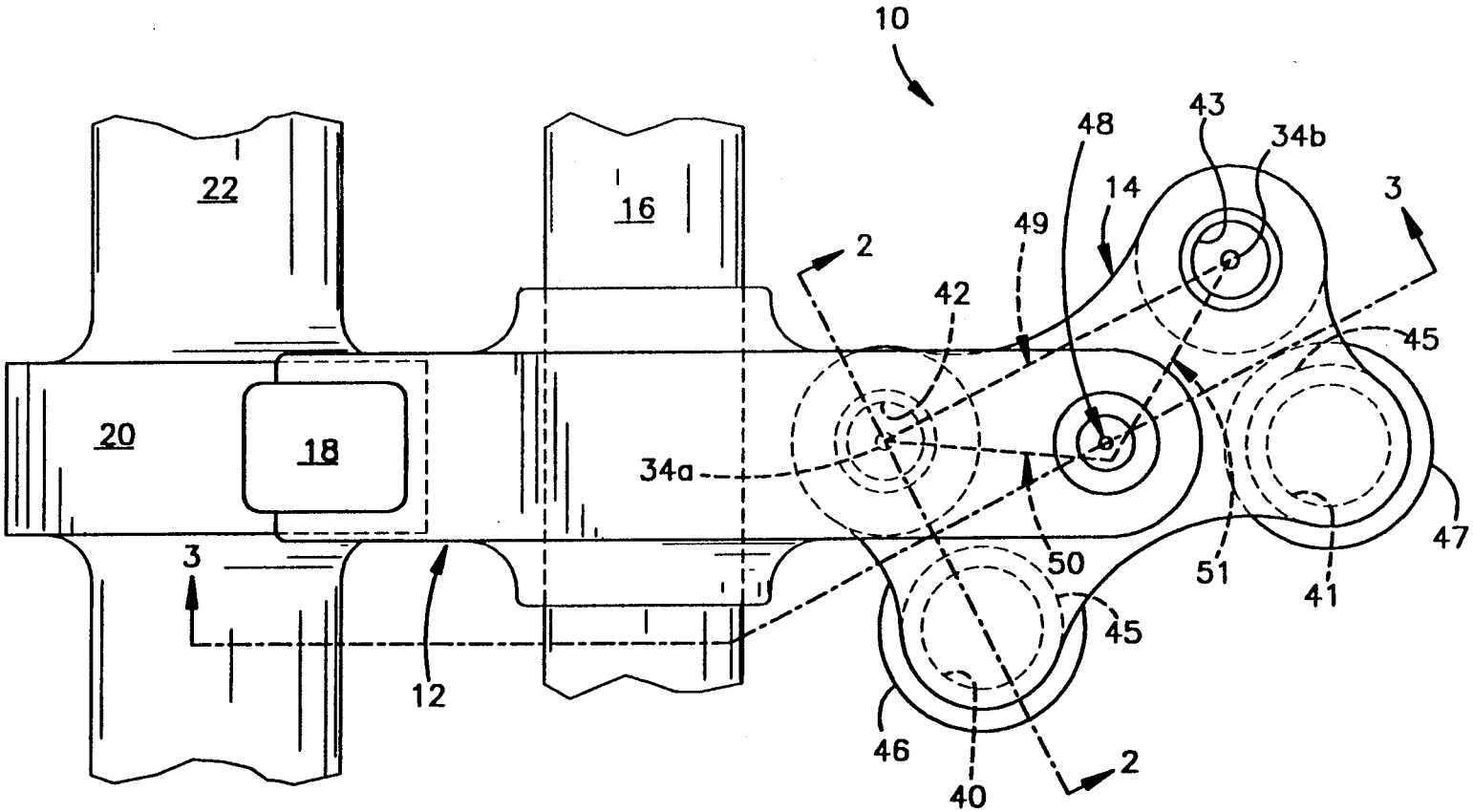
FIG. 1 is a plan view of the invention.

Referring to the drawings, there is illustrated a valve actuating assembly 10 for an internal combustion engine (not shown) comprising a rocker arm 12 and an actuating plate 14. The rocker arm 12 is mounted for rotation on a rocker shaft 16, and includes a roller 18 engageable with a cam lobe 20 of a camshaft 22. The design of the rocker arm per se and the arrangement of the rocker arm, rocker shaft and cam shaft follow well established principles in internal combustion engine design and are not part of the present invention.

Figure 3:
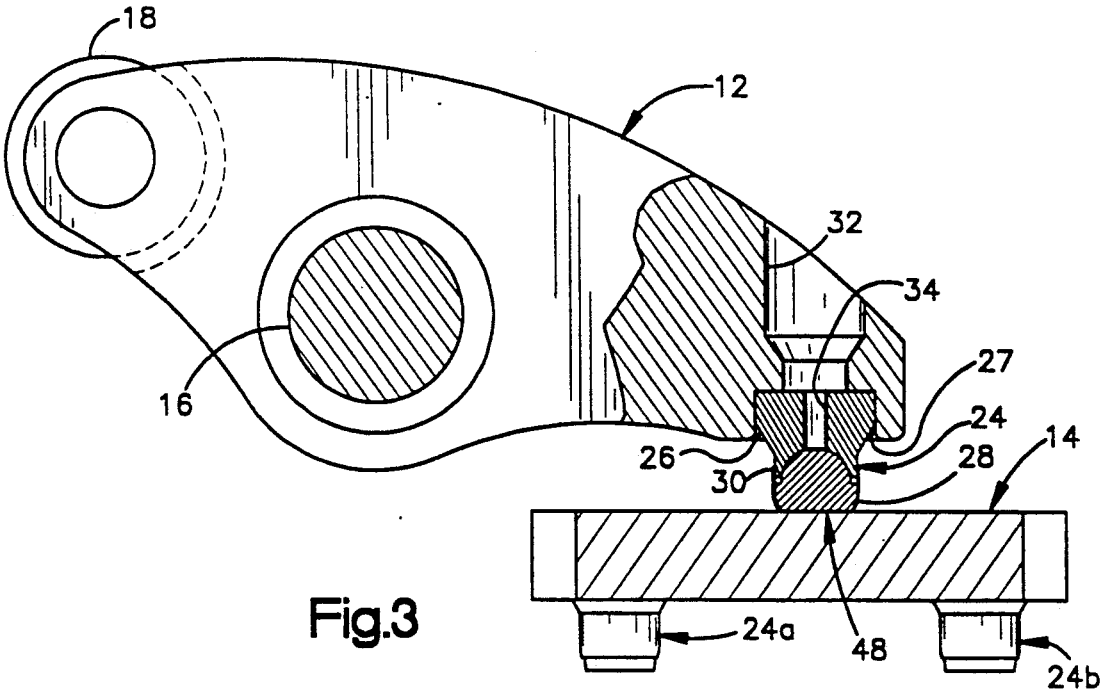
FIG. 3 is a sectional view taken at line 3—3 of FIG. 1.

Referring particularly to FIG. 3, the end of the rocker arm 12 opposite the cam follower roller 18 includes a ball-and-socket assembly 24 comprising a socket member 26 received in a bore 27 formed in the rocker arm, a ball member 28, and a spring retainer 30 which is received over the ball and is received in an annular groove formed in the socket member to retain the ball member and socket member together as a unit prior to assembly in an engine. A stepped bore 32 is formed in the rocker arm in alignment with a bore 34 formed in the socket member to provide a lubricating oil path to the ball-and-socket assembly. Oil can also be ported from the rocker shaft to the bore 34 as is well known in the art.

Figure 2:
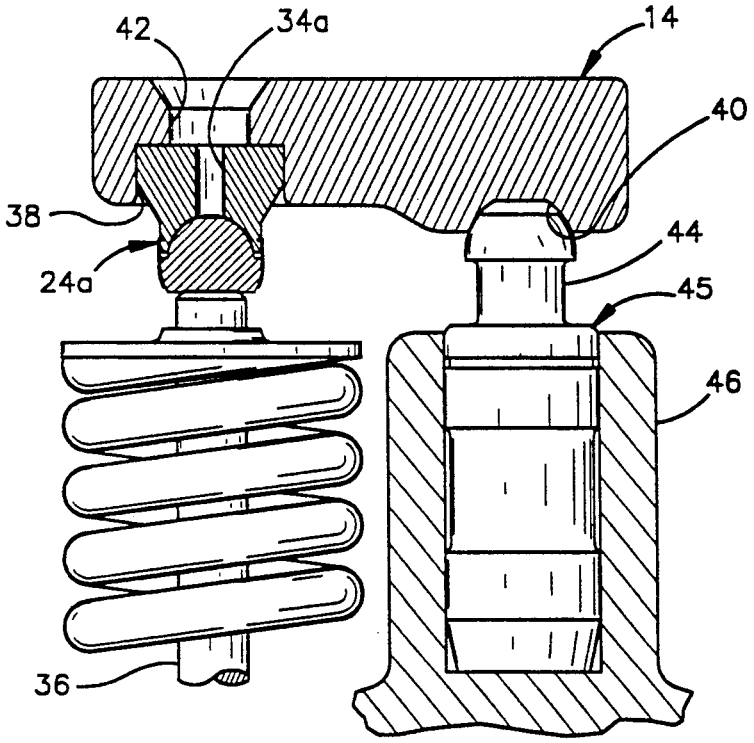
FIG. 2 is a sectional view taken on line 2—2 of FIG. 1.

The actuating plate 14 is of "butterfly" shape in plan view and is oriented relative to the rocker arm in position to actuate a pair of intake or exhaust valves 36. Referring particularly to FIGS. 2 and 3, in the preferred embodiment shown, the plate 14 has a flat top surface and the bottom surface is formed with bores 38 and 39, each of which receives a ball and socket assembly 24*a* and 24*b*; and sockets 40 and 41, all arranged as shown in FIG. 1, the ball and socket assembly 24*a* being aligned with a poppet valve 36, and the ball and socket assembly 24*b* being similarly aligned with a second valve (not shown). Bores 42 and 43 are formed in the plate 14 and bores 34*a* and 34*b* are formed in the ball and socket assemblies 24*a* and 24*b* to provide lubrication.

The sockets 40 and 41 are aligned with plungers 44 of stationary lash adjuster assemblies 45 received in hollow towers 46 and 47 formed on the cylinder head (not shown) of the engine. Lash adjusters of this type are well known in the art as described in U.S. Pat. No. 4,596,213 to Hillebrand and incorporated herein by reference, and will not be described herein in detail. For purposes of this description it is important to note that the lash adjusters operate to maintain a zero lash condition in the valve actuating assembly 10 regardless of the source of lash and independent of any variation from valve-to-valve. It should be noted that lubrication for the ball and socket assemblies 24*a* and 24*b* can also be provided by passages (not shown) providing flow paths between the sockets 40 and 41 and the bores 42 and 43, with oil being provided via ports formed in the sockets 44 of the lash adjuster assemblies 45 as is common practice in the art.

In accordance with the invention, the plate 14 is constrained laterally only by the engagement of the plungers 44 of the lash adjusters with the sockets 40 and 41, the engagement between the rocker arm 12 and the plate 14 being the contact of the flat bottom surface of the ball member 28 with the flat top surface of the plate, and the engagement of the plate 14 with the valves 36 being the contact of the ball and socket assemblies 24*a* and 24*b* with the tips of the valves 36.

While the plate 14 is illustrated herein as being a flat plate of "butterfly" outline, the actual configuration of the actuating member is not critical so long as the point of contact 48 of the rocker arm with the actuating member when the cam follower roller 18 is on the base circle of the cam 20 remains within a triangle (shown in broken line in FIG. 1) having one side 49 defined by a line connecting the centerline of the two valve tips and the remaining sides 50 and 51 defined by lines connecting the centerline of each valve tip and the centerline of the diagonally opposite lash adjuster.

I claim:

1. A valve operating system for an internal combustion engine comprising a first valve, a second valve, a first lash adjuster, a second lash adjuster, and a rocker arm pivotally mounted on said engine, said rocker arm having a cam follower means thereon; and a valve actuating member in contact with said rocker arm, said actuating member having a first valve contacting surface, a second valve contacting surface, a first lash adjuster contacting surface, and a second lash adjuster contacting surface formed thereon.

2. A system as claimed in claim 1 in which said valve and lash adjuster contacting surfaces and the contacting surface between said rocker arm and said actuating member are arranged such that said actuating member is operable to pivot about a line connecting the centers of the lash adjuster contacting surfaces when a valve opening force is applied to said actuating member by said rocker arm.

3. A system as claimed in claim 1 in which said rocker arm and said valve and lash adjuster contacting surfaces are arranged such that said rocker arm contacts said actuating member at a point which lies within a triangle having one side defined by a line connecting the centers of said first and second valve contacting surfaces and remaining sides of the triangle defined by lines connecting the center of each of the valve contacting surfaces with the center of a respective diagonally opposite lash adjuster contacting surface.

4. A system as claimed in claim 1 in which said valve and lash adjuster contacting surfaces are arranged such that their centers define the corners of a rectangle.

* * * * *